United States Patent [19]

Howard et al.

[11] Patent Number: 4,765,492

[45] Date of Patent: Aug. 23, 1988

[54] DISPLAY ASSEMBLIES FOR INTEGRATED MODULAR STORE FIXTURE SYSTEM

[75] Inventors: Fred Howard, New York; Sydney Edson, East Meadow, both of N.Y.

[73] Assignee: Sara Lee Corporation, Winston-Salem, N.C.

[21] Appl. No.: 61,445

[22] Filed: Jun. 15, 1987

[51] Int. Cl.[4] ..... A47F 5/00

[52] U.S. Cl. ..... 211/55; 108/61; 211/126; 211/184

[58] Field of Search ..... 211/55, 184, 126, 187; 108/108, 109, 61

[56] References Cited

U.S. PATENT DOCUMENTS

| | | | |
|---|---|---|---|
| 2,516,122 | 7/1950 | Hughes | 108/61 X |
| 2,914,184 | 11/1959 | Dgetluck | 211/55 |
| 3,308,964 | 3/1967 | Pistone | 211/184 |
| 4,615,276 | 10/1986 | Garabedian | 108/61 |

FOREIGN PATENT DOCUMENTS

| | | | |
|---|---|---|---|
| 2329234 | 5/1977 | France | 108/108 |
| 328373 | 4/1958 | Switzerland | 108/108 |

*Primary Examiner*—Robert W. Gibson, Jr.
*Attorney, Agent, or Firm*—McAulay, Fields, Fisher, Goldstein & Missen

[57] ABSTRACT

An integrated modular store fixture system provided with display assemblies, each having side support members and a base therebetween. At least one separator is disposed parallel to the side support members and perpendicular to the base and is mounted for slidable movement across the front of the display assembly to permit adjustment of the position thereof while preventing upward movement of the separator. As a result, the display assembly can be selectively configured to receive and display packages of different sizes.

18 Claims, 7 Drawing Sheets

62
X-LARGE
LARGE
MEDIUM
SMALL
X-LARGE
LARGE
MEDIUM
SMALL
23
65
64
61

640
647
646
645
644
641
642
64

DISPLAY ASSEMBLIES FOR INTEGRATED MODULAR STORE FIXTURE SYSTEM

BACKGROUND OF THE INVENTION

The present invention relates to a modular store fixture system designed to display packaged goods in multiple sections with each section having a plurality of trays and shelves to store and dispense the products on display.

A modular store fixture system of this type is disclosed in copending U.S. application Ser. Nos. 833,586, filed July 9, 1986, and 015,147 filed Feb. 17, 1987. The contents of these two applications are incorporated herein by reference.

In the known modular store fixture system, a product presentation is obtained which is based on the rate of sale, making for better management of the category. The system is provided with a plurality of of C-shaped rigid frame members, each having two horizontal arms and a vertical spine connecting the two arms. A plurality of rigid spacer elements connect the frame members together in a spaced apart parallel relationship and trays or shelves for holding merchandise to be displayed are mounted between successive spines or vertical members. Each of the spines or vertical members comprises side surfaces having a series of aligned holes spaced apart at center-to-center distances of about ½". Tray and shelf display assemblies coact with the aligned holes to be mounted in place.

The display assemblies disclosed in the known store fixture systems have a front, a rear, a base and side support members on both sides of the base. Means are provided which project from the side support members for engaging the aligned holes to retain the display assembly in place between two vertical members with the front facing outwardly.

SUMMARY OF THE INVENTION

The main object of the present invention is to provide an improved display assembly which can be selectively configured to accomodate and display packages of different sizes.

Another object of the present invention is to provide a configurable knitwear or softwear shelf which has variable spacing of the lengthwise separators and which easily and conveniently assembles with the transverse separators.

A still further object of the present invention is to provide a universal step tray which has lengthwise separators which can be slidably positioned to form compartments of any desired width to display and maintain packages of softgoods in a neat and orderly arrangement.

These and other objects and advantages of the present invention are achieved in accordance with the present invention by an improved display assembly which includes at least one separator disposed parallel to the side support members and perpendicular to the base and means mounting each separator on the base for longitudinal slidable movement to permit adjustment of the position thereof while preventing upward separation of each separator from the base.

The knitwear shelf according to the present invention includes a planar base and the separator is a planar member having slots extending downwardly from the top surface thereof. A plurality of second planar separator members extend transverse to the side supports and are configured to be received in the slots in the first mentioned separator members to define compartments on the shelf.

The first mentioned separators which are disposed parallel to the side supports, are able to be longitudinally slidably adjusted across the entire length of the shelf by means of a sliding member disposed downwardly from the bottom front surface of the separator and which is received in a channel disposed downwardly from the level of the base and extending along the front edge of the base. The channel is configured to slidably receive the sliding member.

In order to prevent the sliding member from being inadvertently or undesirably removed in an upward direction from the base, the sliding member has a projection that lies below the narrow opening of the channel when the member is slidably received in the channel. The projection constrains the member for sliding movement within the channel and prevents upward removal of the member through the channel opening.

The universal step tray has a base comprising a plurality of steps each including perpendicular surfaces including rising surfaces and base surfaces. Attached to each base surface is a planar backing member configured to extend between the side supports and having a height which is greater than that of the rising members so that it extends above the base surfaces.

The backing members are held in place on the rising surfaces by means of a locking member disposed at the bottom edge of the backing member and which is received in an aperture in the base surface. The locking member includes a one-way detent member which engages the underside portion of the base surface to lock it in place. The backing member also includes an aperture which engages an upwardly slanting locking member protruding from the rising surfaces and which engages the aperture when the locking member is inserted in the aperture in the base surface.

Each movable separator for the step tray comprises a planar member having a top surface and a stepped bottom surface including base edges and rising edges with slots extending upwardly from each rising edge and configured to slidably receive the upper portion of the backing members so that the base edges abut the base surfaces and the rising edges abut the backing members.

The separators are prevented from upward movement by a projection extending along the length of every other backing member at a lower portion thereof and means forming a slot at the lower portion of every other rising edge and configured to receive the projection therein.

These and other objects and advantages of the present invention will be more completely disclosed with reference to the following detailed description, taken with the attached drawings, wherein:

DETAILED DESCRIPTION OF THE INVENTION

Figure 1:
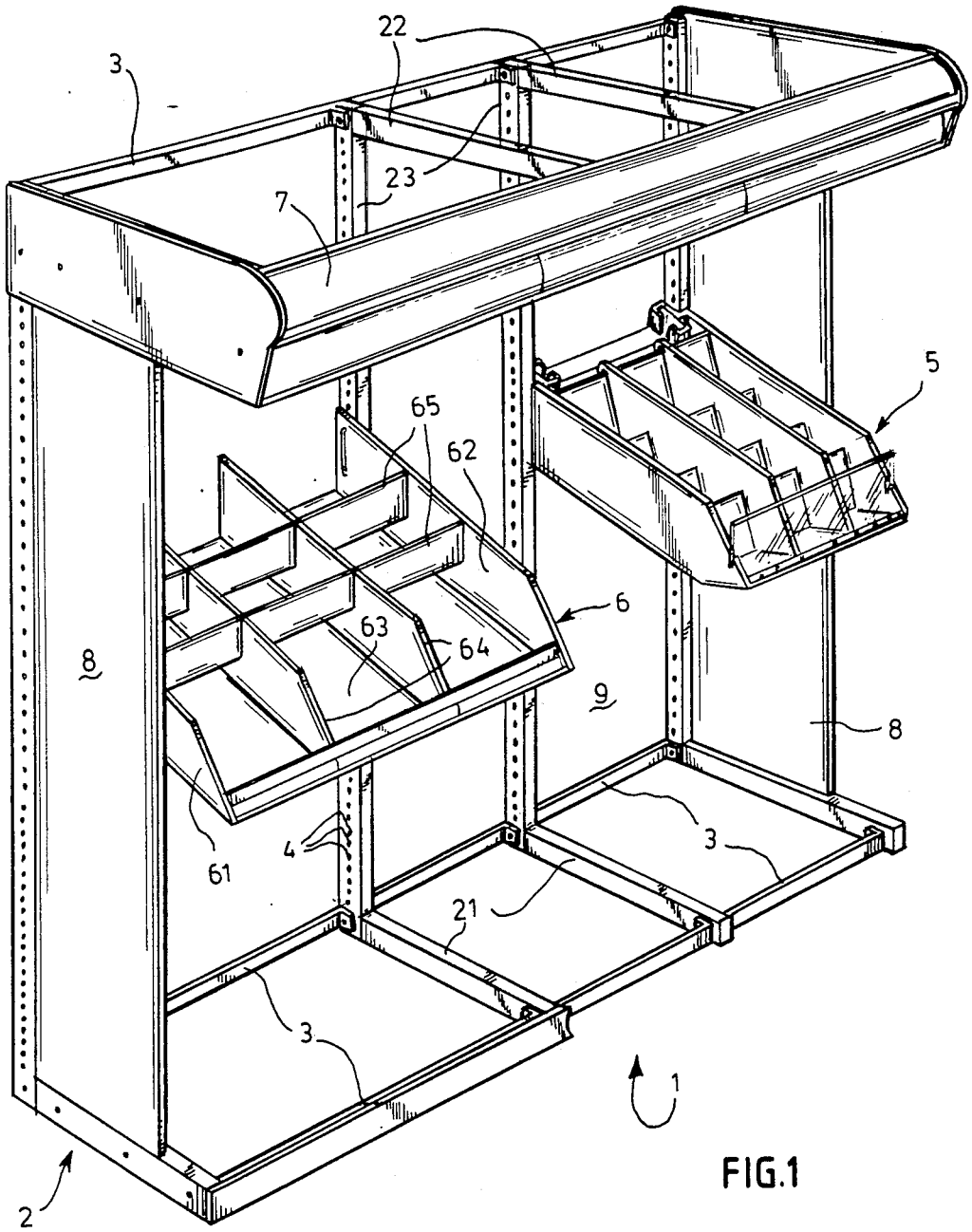
FIG. 1 is a perspective view of the integrated modular store fixture system with display assemblies including a shelf and a step tray in accordance with the present invention.
Figure 4:
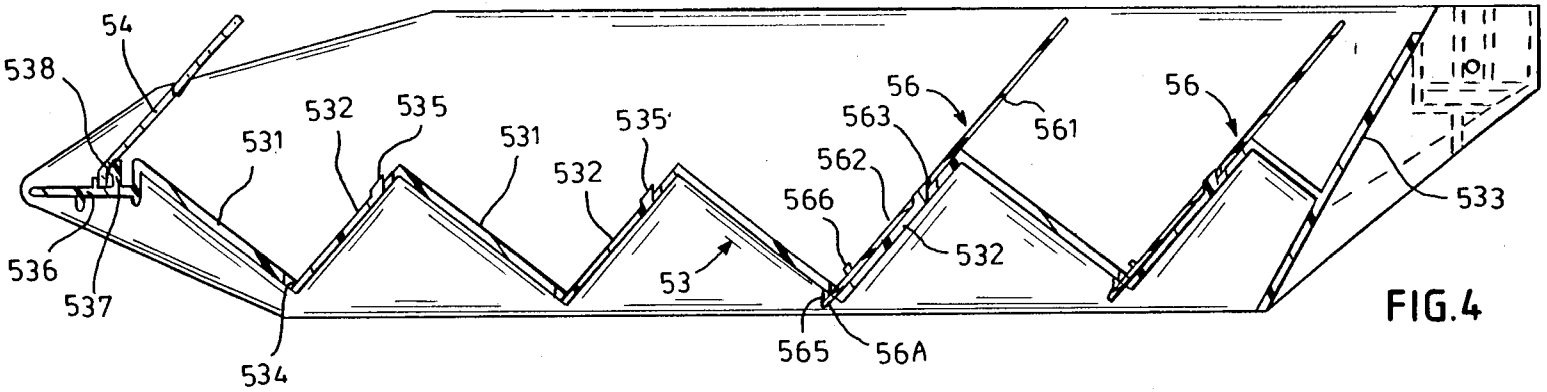
FIG. 4 is a sectional view of the step tray of FIG. 3 along line IV—IV.

FIG. 1 illustrates the integrated modular store fixture system 1 which includes a plurality of C-shaped frame members 2. The members 2 include horizontal side arms 21 and 22 and a vertical spine 23 at a rear portion of the system.

Successive frame members 2 are connected by means of three connecting members 3 at the free ends of both arms 21 and 22 and at the ends of spine 23 in order to fix the successive frame members in a spaced apart parallel relationship. Each vertical spine 23 has a series of aligned holes 4 on side surfaces thereof for effecting mounting of display elements. The C-shaped frame members and spacer elements are disclosed in more detail in the aforementioned copending application Ser. No. 883,586 filed July 9, 1986.

The display assemblies 5 and 6 shown in FIG. 1, are provided for holding merchandise such as packages to be displayed. The display assemblies, depending on the size of the packages to be displayed, can be disposed at different vertical spacing. For the sake of clarity, only two trays are shown in FIG. 1. The manner in which the display assemblies are mounted on the vertical spines 23 utilizing holes 4 is disclosed in considerable detail in the aforementioned U.S. application Ser. No. 883,586 filed July 9, 1986 with regard to display assembly 5 and the aforementioned application Ser. No. 15,147 filed Feb. 17, 1987 with regard to display assembly 6.

The remaining elements of the display assemblies 5 and 6 will be disclosed hereinafter with more detail with regard to FIGS. 2–9.

Also included in the system is a display head or assembly 7 which is used to hold brand information cards in the lower portion thereof and store information cards in the upper portion thereof. The system also may include side panels 8 and rear panel 9 for closing off the unit and to provide it with a more attractive appearance. The details of the header unit and panels and the mounting thereof are disclosed in more detail in aforementioned copending application Ser. No. 883,586 filed July 9, 1986.

Referring now to FIGS. 2–6, the universal step tray 5 according to the present invention will be disclosed in more detail.

The step tray 5 includes two side support members 51 and 52 having a base 53 mounted therebetween. The base 53 is stepped, that is, it includes base surfaces 531 and perpendicular rising surfaces 532 connected thereto in a stepped pattern. A rear surface 533 is connected to the base 53 and a front surface 536 is disposed at the front of the base and has means 538 forming a channel 537 which receives a transparent front member 54 which is glued or cemented in place.

Figure 2:
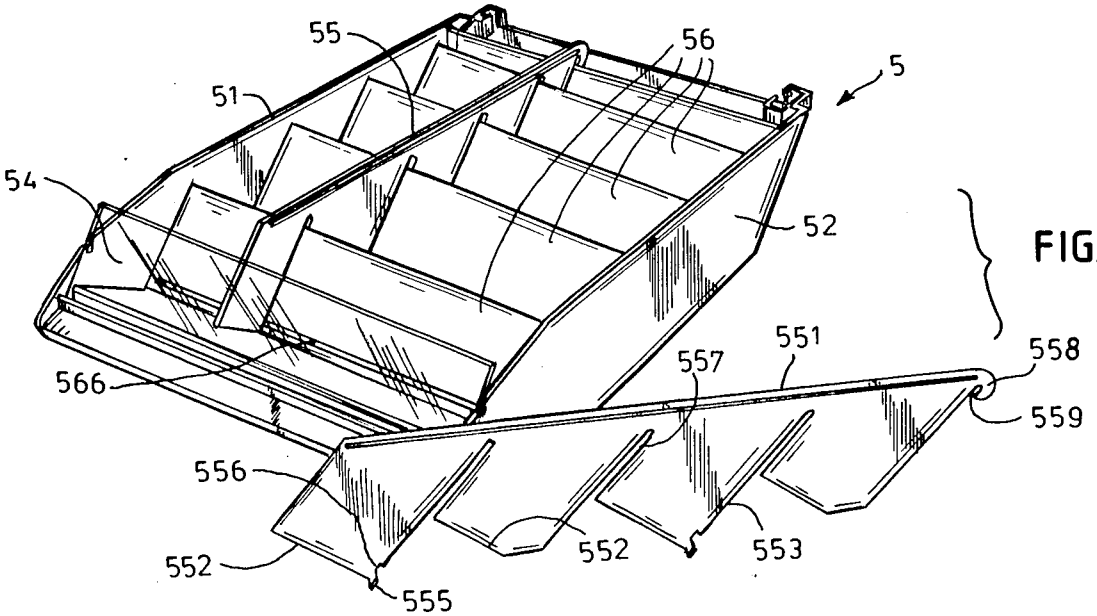
FIG. 2 is a perspective view of the step tray of FIG. 1 in a partially disassembled condition.
Figure 3:
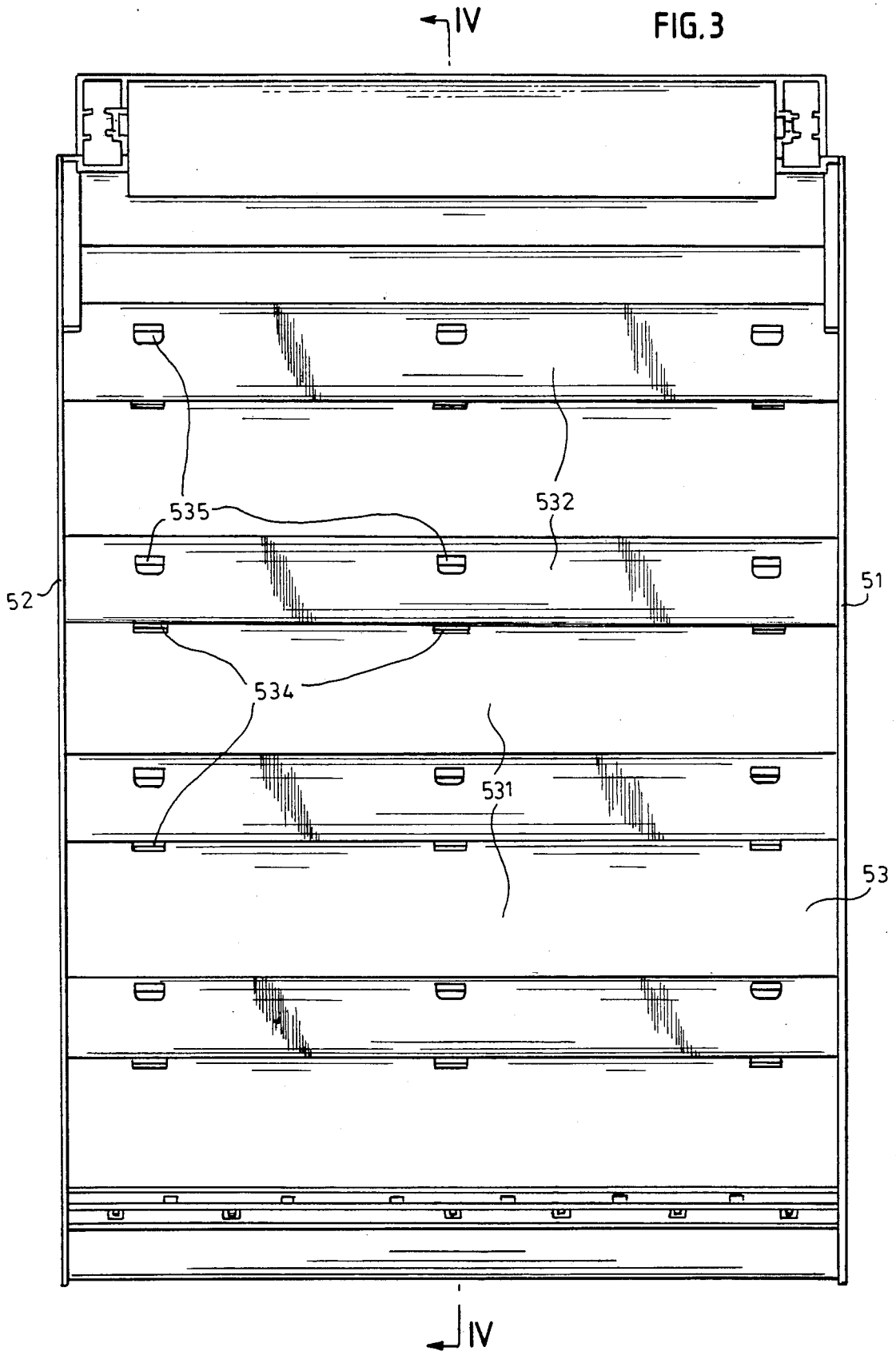
FIG. 3 is a bottom view of the step tray of FIG. 2.

Also connected to the base are a plurality of backing members 56 each including an upper portion 561 which extends above the next succeeding base surface 531 and a lower portion 562 which abuts rising surface 532. The backing members 56 are mounted in place by means of a locking mechanism which includes a projecting locking member 564 having a one way detent 565 thereon and which is received in an aperture 534 in base surface 531. When snapped into place, detent 565 bears against the underside of surface 531 preventing upward removal. As can be seen in FIG. 3 the backing member can preferably have 3 members 564 and the base have three apertures 534 across each base surface. Also holding the backing member 56 in place is an upwardly slanting locking member 535 which projects from rising surface 532 and which is engaged in aperture 563 in the backing member 56. Aperture 563 is provided with a slanted upper lip that mates with and abuts the slanted locking member 535. This engagement prevents the forward motion of the backing member when locked in place. The lower portion 562 of backing member 56 also includes a longitudinal projection 566 which extends across the entire length of the backing member as can be seen in FIG. 2.

Figure 5:
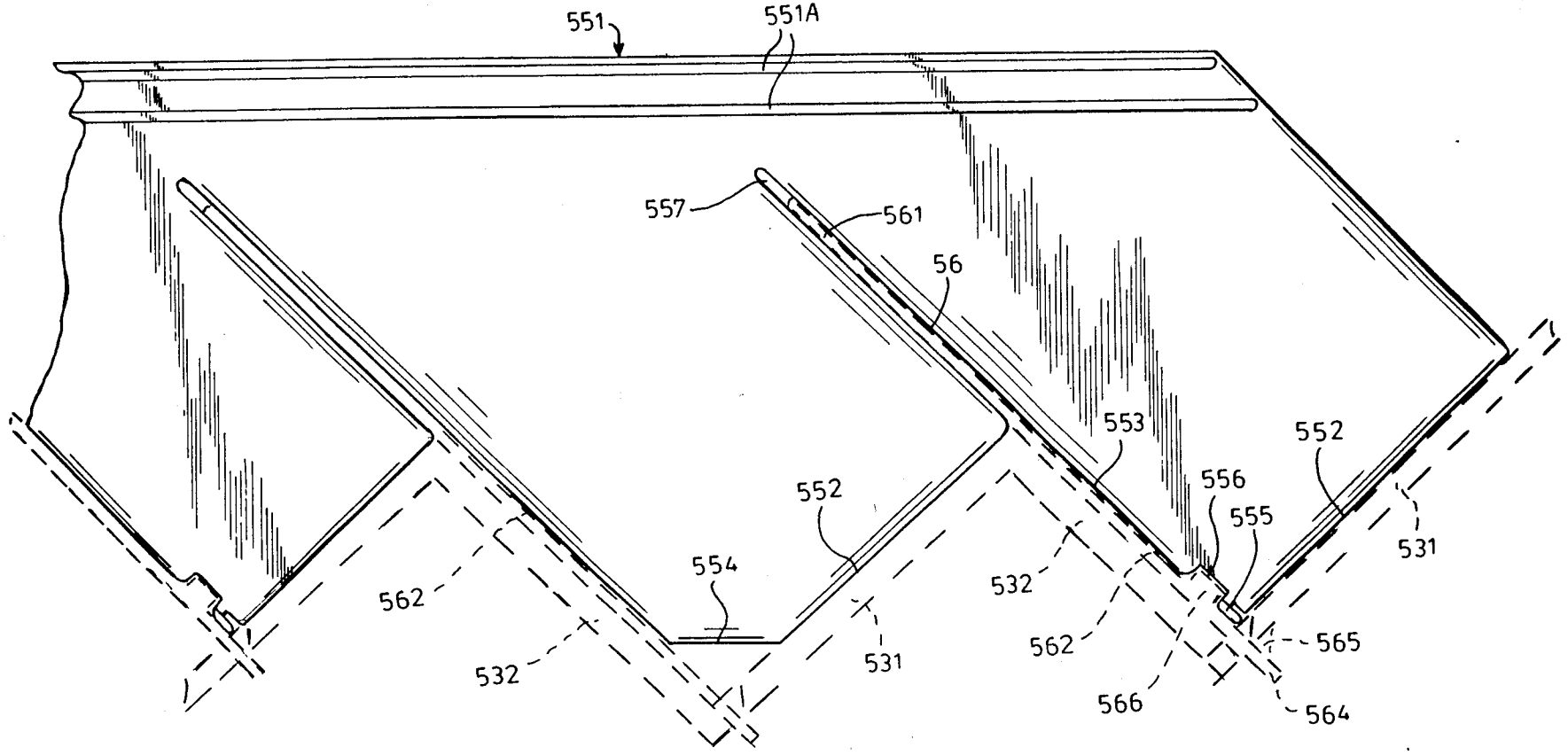
FIG. 5 is a detailed view of the connection between the separator and backing member illustrated in FIG. 2.
Figure 6:
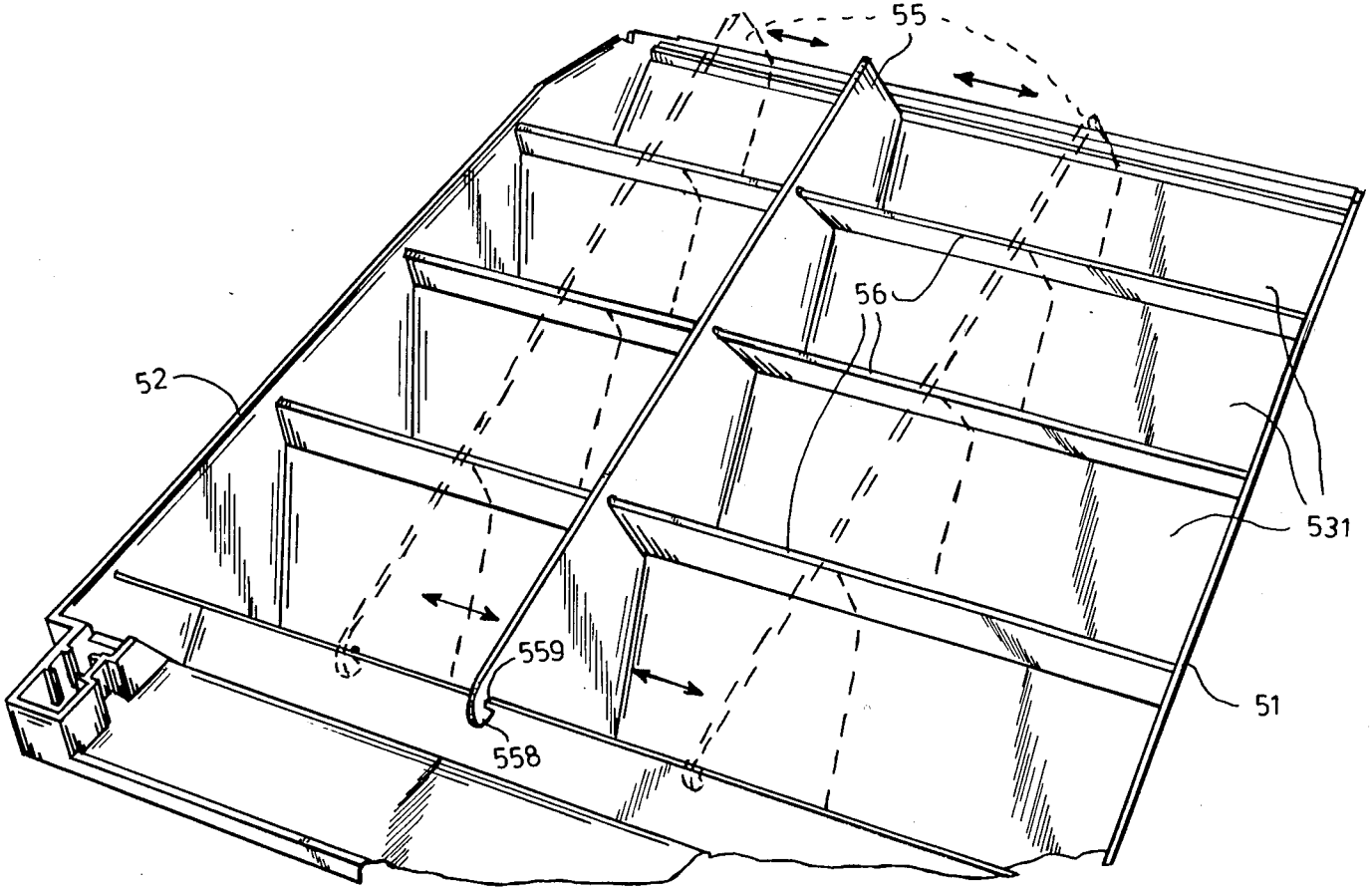
FIG. 6 is a partial perspective view of the step tray of FIG. 2 with the separator shown in various positions.

The step tray 5 in accordance with the present invention is considered to be universal in that it can be configured to receive all differently sized packages by virtue of the fact that separators 55 can be slid into any desired position between side members 51 and 52 as is illustrated in FIG. 6. This flexibility is achieved by virtue of the construction of the separators 55 as shown in FIGS. 2 and 5.

Separators 55 include a top surface 551 and a bottom surface which is stepped complimentary to the step surface of the base 53 and includes base edges 552 and rising edges 553. The separator 55 also includes slots 557 extending upwardly from the rising edges 553 and configured to receive the upper portion 561 of backing members 56. The rear of the separator 55 includes a portion 558 having a slot 559 for receiving the top of the rearmost backing member 556. Longitudinally extending reinforcing ribs 551A extend the length of the member adjacent the top edge.

In order to permit the separator to slide along the length of the backing members, but to prevent upward removal of the separators, mounting means including projecting element 555 and groove or recess 556 are provided which interact with projection 566 of backing members 56 as is shown in more detail in FIG. 5. Mounting means 555, 556 are provided on every other step corner, with alternating corners having a bevelled surface 554 as shown.

In use, the separator 55 is slipped downwardly until member 555 slips over and then under projection 566 and projection 566 snaps into groove 556. This is enabled by means of the fact that the separator 55 is made out of an high impact styrene plastic and is able to deform to enable the separator to slip into place. Once in place, the separator cannot be moved upwardly by merely applying an upward force, but rather must be completely deformed in order to be removed since projection 555 will be captured in the slot formed by projection 556 and member 531.

As can be seen from FIGS. 2–6, backing members 56 can be cemented or glued into place after being mounted, without impairing the ability of the separators 55 to slide into a desired position.

The entire display assembly, except for the mounting means, not shown but described in the aforementioned copending applications, can be made of high impact styrene plastic.

Referring now to FIGS. 1 and 7–9, the shelf 6 which is particularly useful for packages such as knitwear is shown in more detail.

Figure 7:
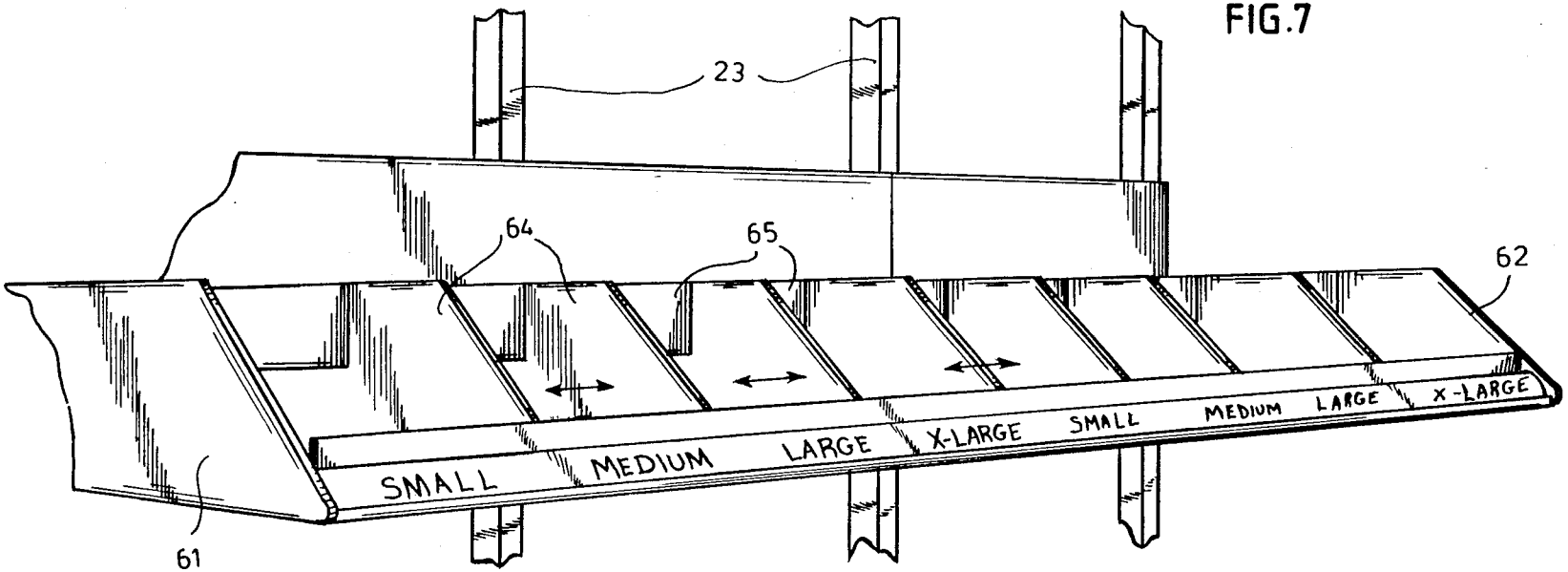
FIG. 7 is a perspective view of the tray shown in FIG. 1.

The shelf 6, as shown in FIGS. 1 and 7, include side support members 61 and 62 with a base 63 connected therebetween. The base 63 is planar in configuration. Disposed along the length of the base 63 are lengthwise separators 64 which are slidably adjustable along the length of the shelf so that the shelf can be divided into three compartments as shown in FIG. 1 or eight compartments as shown in FIG. 7 by merely adding additional separators and sliding them into position. The compartments are additionally formed by longitudinal spacers 65 which are received in slots 641 and 642 in each spacer 64 as shown in FIG. 8.

Figure 8:
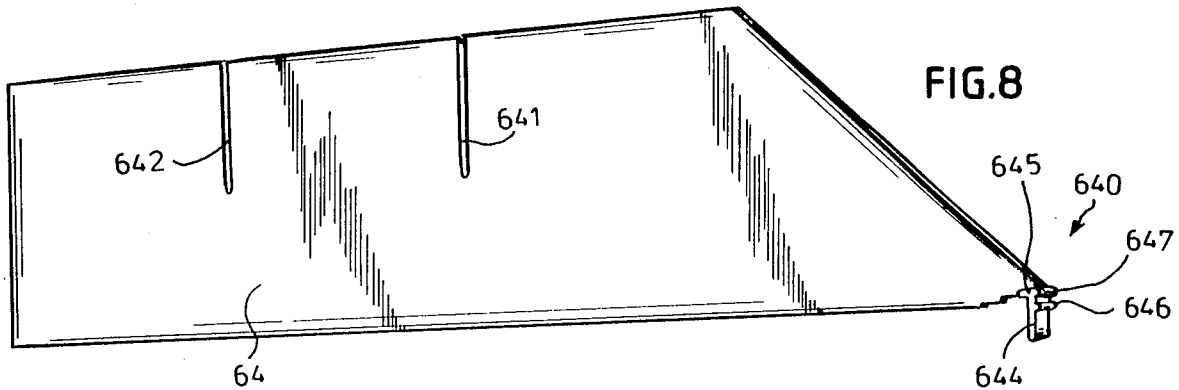
FIG. 8 is a perspective view of the separator of FIG. 7.
Figure 9:
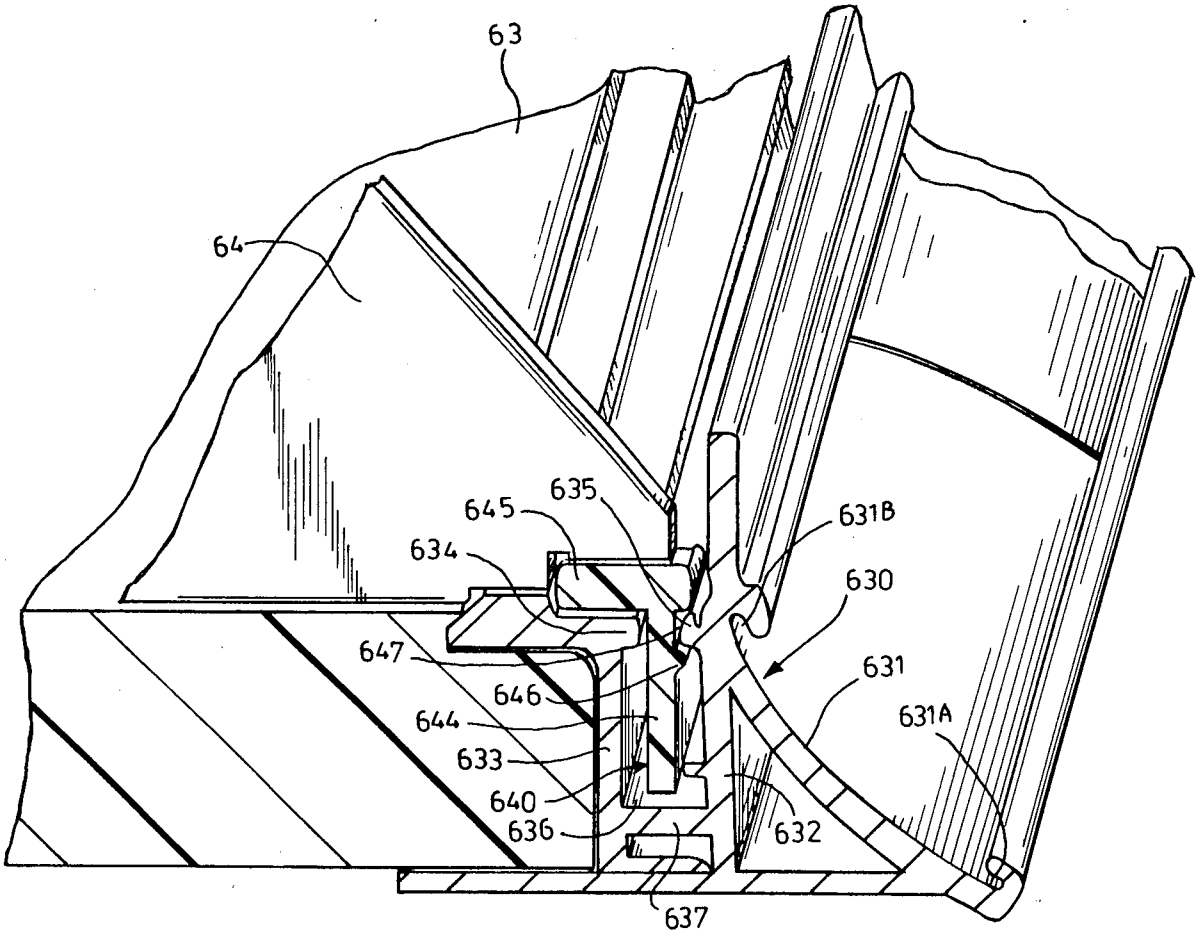
FIG. 9 is a detailed perspective view of the connection between the separator and base of the shelf shown in FIG. 7.

The flexibility of sliding the spacers 64 across the length of the tray is achieved by the means 630 and 640 shown in FIGS. 8 and 9.

Separator 64 has a sliding member 640 thereon which includes a downwardly depending portion 644 and a top portion 645. The portion 644 has a projection or rib 646 which forms a groove 647 with the top portion 645.

The means 630 downwardly depends from base 63 and includes a concave outwardly front portion 631 for holding product or size information in a channel formed by end grooves 631A, 631B. A top extension 631C provides a stop for goods stored on the shelf. The means 630 also includes vertical members 632 and 633 joined by horizontal member 637 in order to form a channel 636 in which member 644 is slidably receivable. At the top of channel 636 is a constriction formed by members 634 and 635, with member 635 slidably receivable in groove 647. Moreover, the rib 646 prevents upward removal of the means 640 since the rib cannot pass through the constricted opening.

The entire unit 630 is made of a high impact styrene plastic. The unit is assembled by first sliding the member 640 into the channel 637 and then attaching the side walls to the base 63.

After the desired number of separator 64 have been put into place and are positioned in the desired position as for example shown in FIG. 1 or FIG. 7, the longitudinal separators 65 are inserted into groove 641 and 642 and the configuration of the tray is completed.

It will be appreciated that the instant specification and claims are set forth by way of illustration and not limitation, and that various modifications and changes may be made without departing from the spirit and scope of the present invention.

What is claimed is:

1. In an integrated modular store fixture system having at least two spaced apart parallel vertical members with side surfaces facing each other and having a series of aligned holes therein and a display assembly having a front, a rear, a base, side support members on both sides of the base and means projecting from the side support members for engaging said holes to retain the display assembly in place between two vertical members with the front facing outwardly, the improvement wherein the display assembly further comprises: at least one separator disposed parallel to the side support members and perpendicular to the base and means mounting the at least one separator on the base for slidable movement across the front of the display assembly to permit adjustment of the position thereof while preventing upward movement of the at least one separator, whereby the display assembly can be selectively configured to receive and display packages of different sizes.

2. The system according to claim 1, wherein the base is planar and has a front edge and a rear edge, wherein the separator comprises a first planar member having a top surface and at least one slot extending downwardly from the top surface, and further comprising at least one second planar separator member for extending parallel to the front and rear edges and slidably receivable in one slot of each at least one first member.

3. The system according to claim 2, wherein the sliding means comprises a first sliding member depending downwardly from a front portion of a bottom edge of the first planar member and means forming a channel between the side support members and extending downwardly from the base at the front edge and parallel to the front edge and configured to slidably receive the sliding member.

4. The system according to claim 3, wherein the means for preventing upward movement comprises means forming a groove on the sliding member disposed parallel to the front edge when slidably received in the channel and a projecting member in the channel extending the length thereof and slidably received in the groove.

5. The system according to claim 1, wherein the base comprises a plurality of steps each including perpendicular surfaces including rising surfaces and base surfaces, wherein the assembly further comprises a plurality of generally planar backing members configured to extend between the side support members and having a height greater than that of the rising surfaces and means mounting the backing members on the base abutting the rising surfaces and extending above the base surfaces.

6. The system according to claim 5, wherein the mounting means comprises at least one aperture in each base surface adjacent the associated rising surface and at least one locking member disposed on a bottom edge of each backing member and having a one way detent member extending therefrom for engaging an underside portion of a base surface when the locking member is inserted in the aperture.

7. The system according to claim 1, further comprising at least one aperture in the backing member at a portion overlying the rising surface and at least one upwardly slanting locking member protruding from the rising surface and engaging an aperture in the backing member when the locking member is inserted in the aperture in the base surface.

8. The system according to claim 5, wherein the separator comprises a planar member having a top surface and a stepped bottom surface including base edges and rising edges with slots extending upwardly from each rising edge and configured to slidably receive an upper portion of the backing members such that the base edges abut the base surfaces and the rising edges abut the backing members.

9. The system according to claim 8, wherein the means preventing upward movement comprises a projection extending along at least one backing member at a lower portion thereof and means forming a slot at a lower portion of at least one rising edge of said separator and configured to receive the projection therein.

10. A display assembly for use in an integrated modular store fixture system, the assembly comprising a base and side support members on both sides of the base and means on said members to connect said assembly to said system, at least one separator disposed parallel to the side support members and perpendicular to the base and means mounting the at least one separator on the base for slidably movement across the front of the display assembly to permit adjustment of the position thereof while preventing upward movement of the at least one separator, whereby the display assembly can be selectively configured to receive and display packages of different sizes, said mounting means including a slot in one out of said base or said separator, said slot having a narrowed mouth, and a sliding member on the other of said base or separator slidably received in said slot and having a portion of greater dimension than said narrowed mouth to prevent removal of said sliding member through said narrowed mouth.

11. The assembly according to claim 10, wherein the base is planar and has a front edge and a rear edge, wherein the separator comprises a first planar member having a top surface and at least one slot extending downwardly from the top surface, and further comprising at least one second planar separator member for extending parallel to the front and rear edges and slidably receivable in one slot of each at least one first member.

12. The assembly according to claim 11, wherein the sliding means comprises a first sliding member depending downwardly from a front portion of a bottom edge of the first planar member and means forming a channel between the side support members and extending downwardly from the base at the front edge and parallel to the front edge and configured to slidably receive the sliding member.

13. The assembly according to claim 12, wherein the means for preventing upward movement comprises means forming a groove on the sliding member disposed parallel to the front edge when slidably received in the channel and a projecting member in the channel extending the length thereof and slidably received in the groove.

14. The assembly according to claim 10, wherein the base comprises a plurality of steps each including perpendicular surfaces including rising surfaces and base surfaces, wherein the assembly further comprises a plurality of generally planar backing members configured to extend between the side support members and having a height greater than that of the rising surfaces and means mounting the backing members on the base abutting the rising surfaces and extending above the base surfaces.

15. The assembly according to claim 14, wherein the mounting means comprises at least one aperture in each base surface adjacent the associated rising surface and at least one locking member disposed on a bottom edge of each backing member and having a one way detent member extending therefrom for engaging an underside portion of a base surface when the locking member is inserted in the aperture.

16. The assembly according to claim 15, further comprising at least one aperture in the backing member at a portion overlying the rising surface and at least one upwardly slanting locking member protruding from the rising surface an engaging an aperture in the backing member when the locking member is inserted in the aperture in the base surface.

17. The assembly according to claim 14, wherein the separator comprises a planar member having a top surface and a stepped bottom surface including base edges and rising edges with slots extending upwardly from each rising edge and configured to slidably receive an upper portion of the backing members such that the base edges abut the base surfaces and the rising edges abut the backing members.

18. The assembly according to claim 17, wherein the means preventing upward movement comprises a projection extending along the length at least one backing member at a lower portion thereof and means forming a slot at a lower portion of at least one rising edge and configured to receive the projection therein.

* * * * *